US005326927A

United States Patent [19]

Stabel et al.

[11] Patent Number: 5,326,927

[45] Date of Patent: Jul. 5, 1994

[54] RECOVERY OF A USEFUL POLYMERIZABLE FRACTION

[75] Inventors: Uwe Stabel, Edingen-Neckarhausen; Gerd Wunsch, Speyer; Helmut Woerz, Mannheim; Andreas Fried, Bobenheim-Roxheim; Ruediger Kotkamp, Limburgerhof, all of Fed. Rep. of Germany

[73] Assignee: BASF Aktiengesellschaft, Ludwigshafen, Fed. Rep. of Germany

[21] Appl. No.: 56,791

[22] Filed: May 4, 1993

[30] Foreign Application Priority Data

Dec. 14, 1992 [DE] Fed. Rep. of Germany ..... 4242054

[51] Int. Cl.[5] ..... C07C 7/00; C10G 9/00; B01D 3/00

[52] U.S. Cl. ..... 585/800; 208/100; 208/103; 208/347; 208/350; 208/355

[58] Field of Search ..... 585/800; 208/347, 350, 208/355, 100, 103

[56] References Cited

U.S. PATENT DOCUMENTS 5,090,977 2/1992 Strack et al. ..... 62/23

*Primary Examiner*—Anthony McFarlane
*Assistant Examiner*—Nhat D. Phan
*Attorney, Agent, or Firm*—Keil & Weinkauf

[57] ABSTRACT

In a process for the recovery of a polymerizable useful fraction, consisting of styrene, methylstyrenes, vinyltoluenes, indene, methylindenes and fractions whose boiling points are between styrene and methylindenes, from the crack gases of a steam cracker, the sidestream of the crack gas column is divided, by means of a distillation unit, into the useful fraction and into fractions which are recycled to the crack gas column.

1 Claim, 1 Drawing Sheet

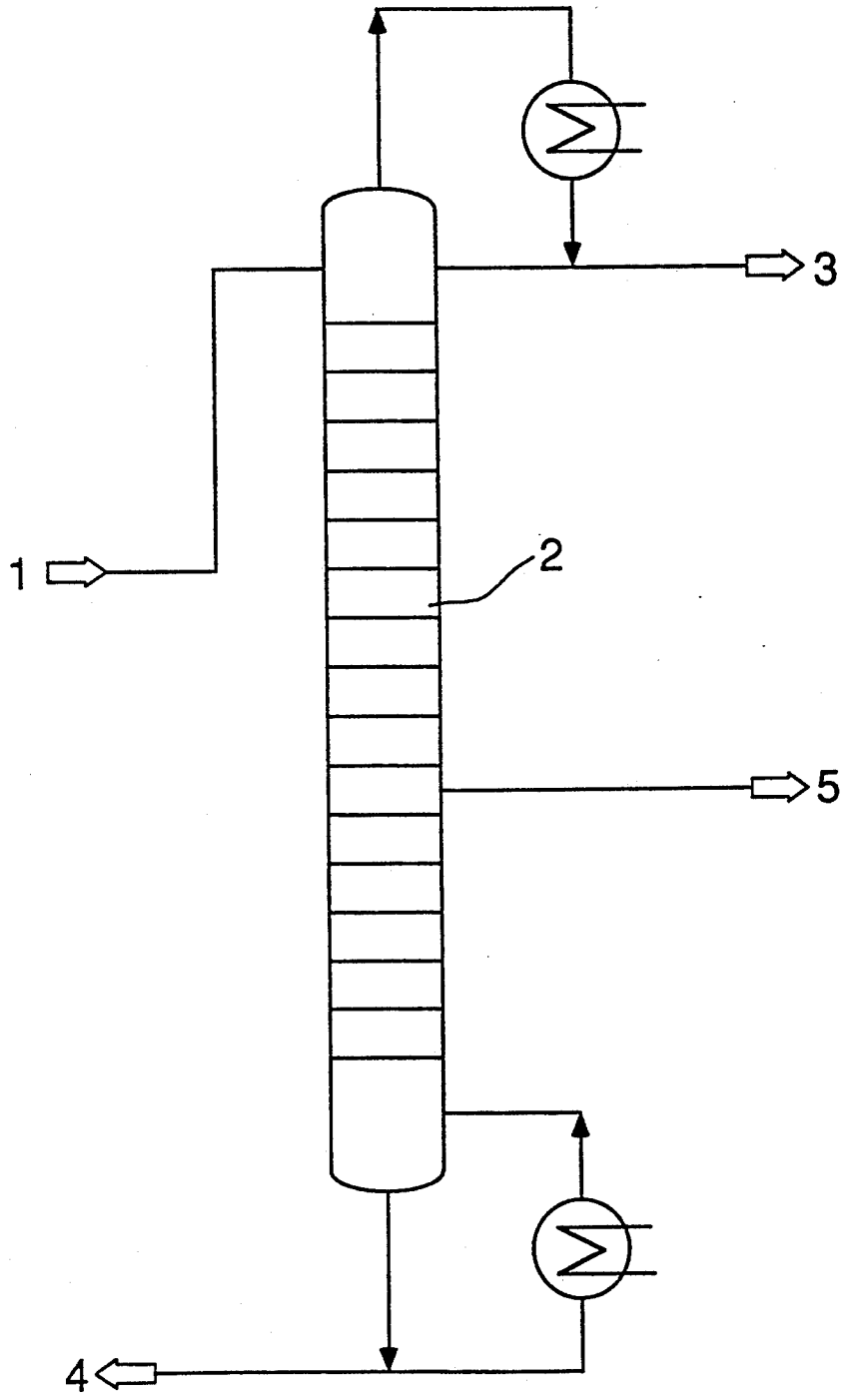
1
2
3
4
5

RECOVERY OF A USEFUL POLYMERIZABLE FRACTION

BACKGROUND OF THE INVENTION

1. Field of the Invention

The description relates to a process for the recovery of a useful, polymerizable fraction, consisting of styrene, methylstyrenes, vinyltoluenes, indene, methylindenes and fractions whose boiling points are between styrene and methylindenes, from the crack gases of a steam cracker.

The above useful fraction is a starting material for various adhesive resins.

2. Description of the Related Art

Processes for the recovery of similar useful fractions are known and are described in the patent literature. For example, Japanese Patent 87-190136 describes a process in which a polymerizable fraction of $C_9$–$C_{10}$-cuts is recovered from residue oil by means of distillation. U.S. Pat. No. 4,371,428 describes a process for separating vinyl toluene from other alkenyl aromatics by means of extraction distillation. For the recovery of indene, U.S. Pat. No. 4,827,078 describes a process which relates to the recovery from a petrochemical mixture by means of adsorption using zeolites.

The processes described have various disadvantages, for example the fact that the desired useful fraction is first recovered from the residue oil and is thus subjected to high thermal stresses. Furthermore, the processes described are energy-consumptive.

SUMMARY OF THE INVENTION

It is an object of the present invention to recover the useful fraction by means of a simple, economical process step.

We have found that the subject is achieved, according to the invention, if a sidestream of the crack gas column is divided, by means of a distillation unit, into the useful fraction and into fractions which are recycled to the crack gas column.

In the novel process, a product stream which contains, for example, the desired components (=useful fraction in a concentration of about 5–55% by weight) is taken off from the crack gas column of the steam cracker, at a suitable tray. Surprisingly, it was found that the separation of the undesirable products and the recovery of the useful fraction are possible by means of a distillation unit (=a column). Those products which have a lower boiling point than the desired product, for example benzene, toluene and parts of the styrene, are taken off at the top of the column and recycled to the crack gas column, advantageously above the take-off tray. Those products which have a higher boiling point than the desired product, for example naphthalene and undesirable $C_{10}$-and higher components, are taken off at the bottom of the column and recycled to the crack gas column, advantageously below the take-off tray. The useful fraction is advantageously removed from the gas phase of the column and is condensed. The novel process gives a high yield of the useful fraction. A further advantage is that the energy consumption is lower when the enriched sidestream of the crack gas column is worked up to obtain the useful fraction than when the useful fraction is recovered by distillation of pyrolysis gasoline. In the event of faults in the column for the recovery of the useful fraction, the working up of the pyrolysis gasoline in the steam cracker is not affected, and, the availability of the steam cracker is not impaired. Finally, a further advantage is that, on the one hand, the useful fraction contains no dicyclopentadiene, which changes the properties of the useful fraction, and, on the other hand, in the recovery of cyclopentadiene/-dicyclopentadiene from pyrolysis gasoline of the steam cracker, the components which have an adverse effect on the purity of the dicyclopentadiene, such as indene or vinyltoluene, have already been separated off.

The useful fraction recovered by the novel process contains, for example, 4% by weight of styrene, 20% by weight of methylstyrene and vinyltoluenes, 20% by weight of indene and 11% by weight of methylindenes.

The novel process is more particularly described below with reference to a simplified process diagram.

BRIEF DESCRIPTION OF THE DRAWING

The Figure represents a simplified process diagram of the present invention.

DESCRIPTION OF THE PREFERRED EMBODIMENTS

In the process diagram, for example, 1 is the product stream (=side stream from the crack gas column) which contains about 5–55% by weight of the useful fraction. This product stream is fed to the top of a distillation unit 2 (=pure stripping column), equipped with an evaporator, condenser, etc. Those products 3 which have boiling points lower than the useful fraction are removed and are recycled to the crack gas column. Those products 4 which have boiling points higher than the useful fraction are taken off at the bottom and are recycled to the crack gas column.

The column is equipped with about 14–18 actual transfer plates, for example dual-flow trays, sieve trays or valve trays. The operating data of the column are as follows:

| | |
|---|---|
| Pressure: | ~1.9 bar at the top |
| Temperature at the top: | ~125° C. |
| Temperature at the bottom: | ~193° C. |
| Temperature at the take-off point of the useful fraction: | ~176° C. |

The take-off point 5 of the useful fraction is located between the 9th and the 13th actual transfer plate, counted from the top of the column.

We claim:

1. A process for the recovery of a useful polymerizable fraction consisting essentially of styrene, methylstyrenes, vinyltoluenes, indene, methylidenes and fractions having boiling points between those of styrene and methylidenes from crack gases of a stream cracker, which process comprises: obtaining a product stream from the steam cracker, feeding the product stream to the top of a distillation unit, removing those products which have boiling points lower than the useful polymerizable fraction and recycling the removed products to the steam cracker, removing those products which have boiling points higher than the useful polymerizable fraction and recycling the removed products to the steam cracker, and recovering the useful polymerizable fraction from the distillation unit.

* * * * *

UNITED STATES PATENT AND TRADEMARK OFFICE

CERTIFICATE OF CORRECTION

PATENT NO.: 5,326,927

DATED: July 5, 1994

INVENTOR(S): STABEL et al.

It is certified that error appears in the above-identified patent and that said Letters Patent is hereby corrected as shown below:

Column 2, claim 1, lines 53 and 55, "methylidenes" should read --methylindenes--

Signed and Sealed this

Fifteenth Day of November, 1994

*Attest:*

*Attesting Officer*

BRUCE LEHMAN

*Commissioner of Patents and Trademarks*